United States Patent [19]

Thijsse

[11] Patent Number: 4,675,998

[45] Date of Patent: Jun. 30, 1987

[54] DRY-SHAVING APPARATUS

[75] Inventor: Carel J. Thijsse, Eindhoven, Netherlands

[73] Assignee: U.S. Philips Corporation, New York, N.Y.

[21] Appl. No.: 780,550

[22] Filed: Sep. 26, 1985

[30] Foreign Application Priority Data

Oct. 9, 1984 [NL] Netherlands ..... 8403065

[51] Int. Cl.[4] ..... B26B 19/14

[52] U.S. Cl. ..... 30/43.6; 30/34.2; 30/43.92

[58] Field of Search ..... 30/43.6, 34.2, 43.4, 30/43.5, 43.91, 43.92

[56] References Cited

U.S. PATENT DOCUMENTS 3,618,210 11/1971 Zuukueen ..... 30/43.6
3,639,979 2/1972 Zuukueen ..... 30/43.6
3,748,731 7/1973 Kuiken ..... 30/43.6
3,903,597 9/1975 Cobarg ..... 30/43.91
3,913,225 10/1975 Tietjens et al. ..... 30/43.6
4,219,930 9/1980 Franko et al. ..... 30/43.92
4,275,497 6/1981 Engelhardt et al. ..... 30/43.6

*Primary Examiner*—E. R. Kazenske
*Assistant Examiner*—Willmon Fridie, Jr.
*Attorney, Agent, or Firm*—Thomas A. Briody; William J. Streeter; Rolf E. Schneider

[57] ABSTRACT

A dry-shaving apparatus includes a shaving unit comprising an external shaving member provided with hair-entry apertures; and an internal shaving member associated with and rotatable relative to the external shaving member, the internal shaving member being formed with a plurality of cutting blades for engagement with the external shaving member. A first resilient element engages the internal shaving member and exerts pressure thereagainst. A ball bearing member is centrally positioned between the external shaving member and the internal shaving member and engages the internal shaving member. A second resilient element is associated with the external shaving member and engages the ball bearing member.

6 Claims, 9 Drawing Figures

DRY-SHAVING APPARATUS

This invention relates to a dry-shaving apparatus having at least one shaving unit which comprises an external shaving member with hair-entry apertures and an internal shaving member which has cutting elements or blades and can be rotated relative to the external shaving member, a central bearing member, for example a ball, being arranged between the internal shaving member and the external shaving member and at least one of the shaving members being engaged and supported by means of a resilient pressure element.

Such a dry-shaving apparatus is disclosed in U.S. Pat. No. 2,824,367. The pressure of the resilient pressure element is transmitted to the external shaving member partly by the ball constituting the central bearing member. This has the advantage that it reduces loss of power and wear as a result of the friction between the cutting elements and the external shaving member. However the ratio between the part of the pressure transmitted by the ball and the total pressure is difficult to adjust and, moreover this ratio will not be constant as a result of wear.

It is the object of the invention to mitigate these drawbacks and to this end the invention is characterized in that an additional resilient element is arranged between the central bearing member and is associated with at least one of the shaving members.

Invention will now be described in more detail with reference to the accompanying drawings in which.

Figure 1:
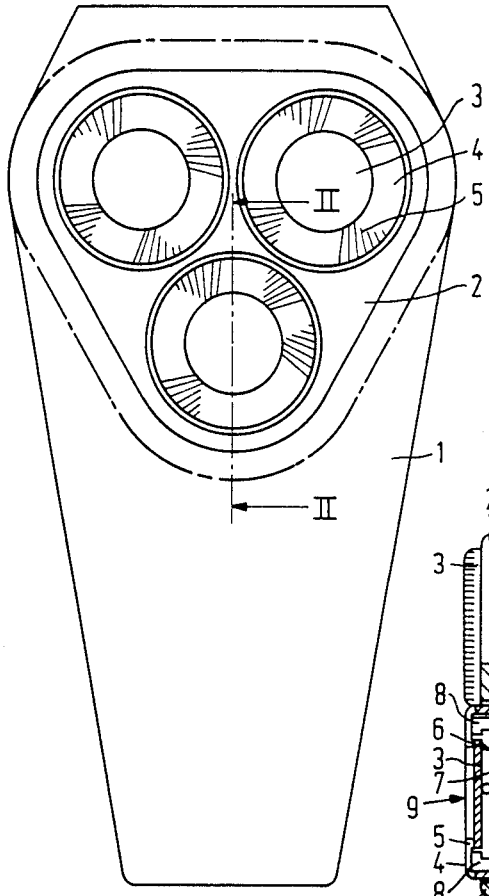
FIG. 1 is an elevation of a dry-shaving apparatus comprising three shaving units.
Figure 2:
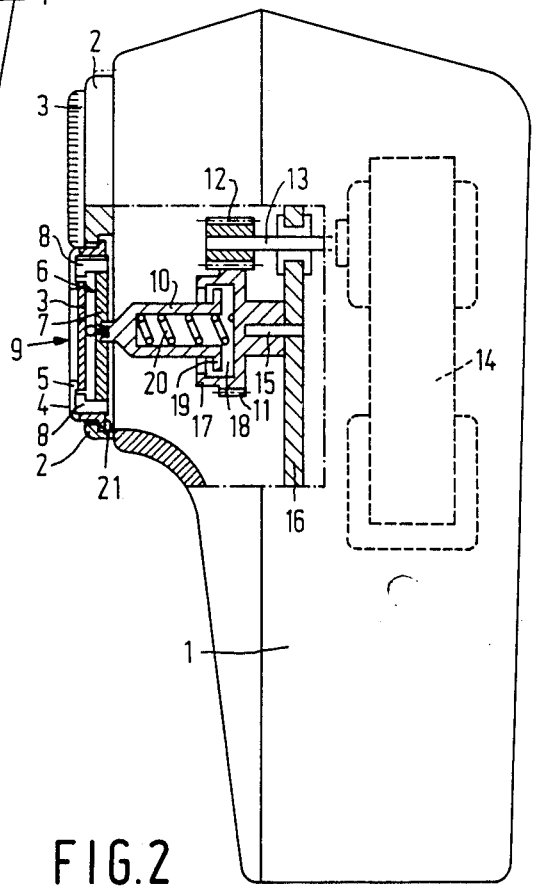
FIG. 2 shows the shaving apparatus in side view and partly in a sectional view taken on the line II—II in FIG. 1.

The dry-shaving apparatus shown in FIGS. 1 and 2 comprises a housing 1 of which part is constructed as a holder 2 for three external shaving members 3. Each external shaving member 3 is formed with an annular shaving portion 4 with hair-entry apertures 5.

The sectional part of FIG. 2 shows an internal shaving member 6 arranged at the inner side of the external shaving member 3, which for the sake of clarity is shown only schematically in FIG. 2. Each internal shaving member 6 comprises a central body 7 carrying a set of circumferential cutting elements or blades 8 which face annular shaving portion 4 of the respective external shaving member 3. Each external shaving member 3 and the associated internal shaving member 6 together constitute a shaving unit 9.

By means of a coupling spindle 10, gear wheels 11 and 12 and a shaft 13, each internal shaving member 6 is coupled to a drive mechanism, generally an electric motor 14, for rotation thereby relative to the associated external shaving member 3. Each gear wheel 11 is journalled on a pin 15 mounted in a mounting plate 16. The gear wheel 11 has a hub 17 with an internal recess 18. For transmitting the rotary movement of the gear wheel 11 to the associated coupling spindle 10 one end of the coupling spindle is provided with a flange 19 which engages in the recess 18. Moreover, the respective shaving unit is engaged and supported by the coupling spindle 10 by means of a resilient pressure element, constructed as a first helical spring 20 which for the greater part is situated within the coupling spindle 10. This helical spring 20, which is compressed between the coupling spindle 10 and the gear wheel 11, exerts a force on the coupling spindle which is directed towards the shaving unit 9. This force is exerted on the internal shaving member 6 via the coupling spindle 10 and on the external shaving member 3 via the internal shaving member, so that the flange 21 on the rim of the external shaving member 3 is urged against the holder 2. The external shaving member 3, together with the internal shaving member 6 and the coupling spindle 10, can be pressed inwards against the action of the resilient element 20 by external forces such as those which may occur during use of the shaving apparatus.

The coupling to the electric motor 14, as described above, is identical for the three internal shaving members 6 of the apparatus shown in FIGS. 1 and 2, in which the three gear wheels 11 mesh with the single central gear wheel 12 on the motor shaft 13.

Figure 3:
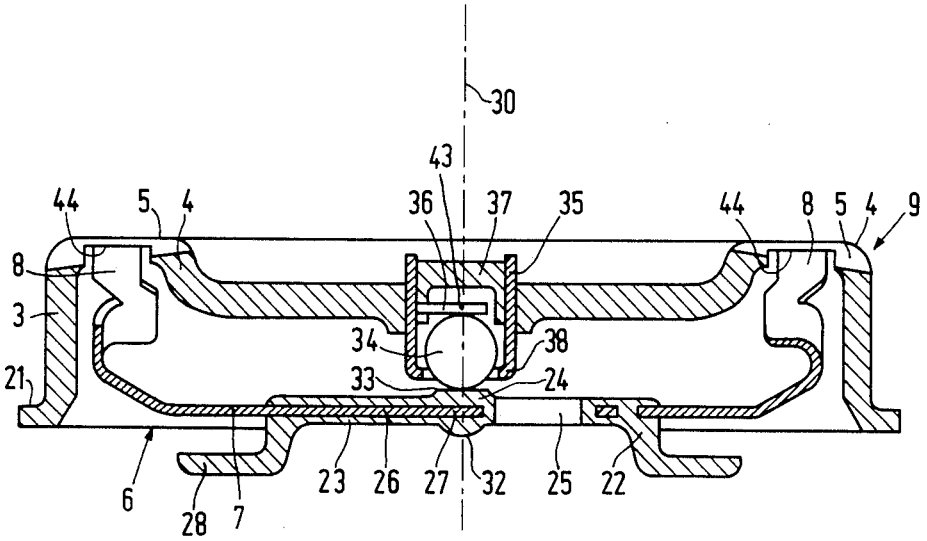
FIG. 3 is an enlarged-scale sectional view of a shaving unit.
Figure 4:
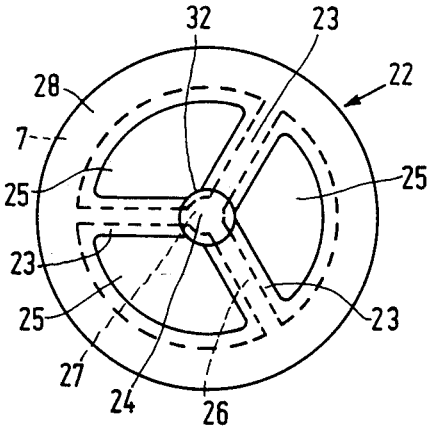
FIG. 4 is an underneath view of the coupling member for the internal shaving member shown in FIG. 3.

Each internal shaving member 6 is provided with a coupling member 22, for example of a plastic, comprising three spokes 23 radiating from and interconnected by a central portion 24. Between the spokes coupling apertures 25 are formed. The coupling member 22 encloses the central body 7 of the internal shaving member 6, which is constructed correspondingly, comprising spokes 26 and a central portion 27. The central body 7 is integral with the cutting elements 8. The coupling member 22 also has a flange 28 (FIGS. 3 and 4).

Figure 5:
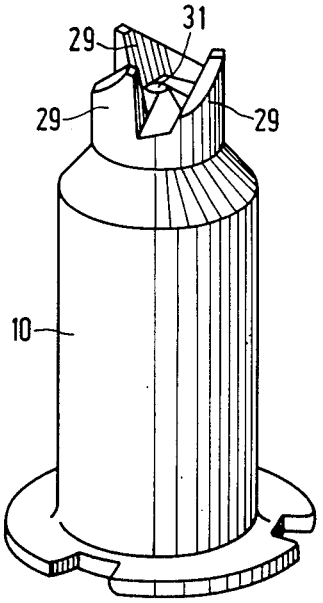
FIG. 5 is a perspective view of the coupling spindle.

The end of the coupling spindle 10 (FIG. 5) carries three coupling fingers 29, which in the assembled condition of the apparatus engage in the apertures 25 and abut the spokes 23 of the coupling member 22. In this way the coupling spindle 10 is coupled to the internal shaving member 6 to rotate this member about an axis of rotation 30. The coupling spindle 10 has a central thrust surface 31 which bears against the lower surface 32 of the central portion 24 of the coupling member 22.

A central bearing memeber 34, which is constructed as a ball, bears against the upper surface 33 of the central portion 24 of the coupling member 22. This ball 34 is situated in a holder 35 within which is also situated or positioned a second, additional resilient element 36. The additional resilient element 36 is supported by a cup-shaped member 37. The holder 35 is secured in the centre of the external shaving member 3, for example by spot-welding. The ball 34 is retained in the holder by an inwardly flanged rim 38 on the holder.

Figure 6:
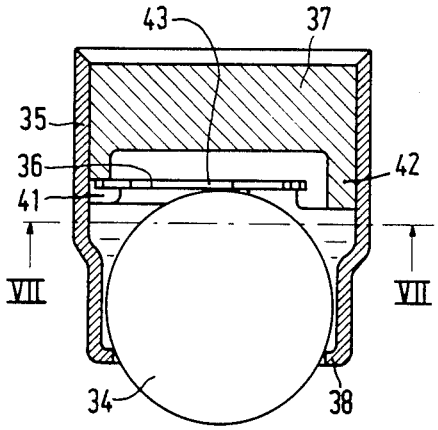
FIG. 6 is an enlarged-scale sectional view of the holder with the central bearing member, the additional resilient element and a member which supports this element.
Figure 7:
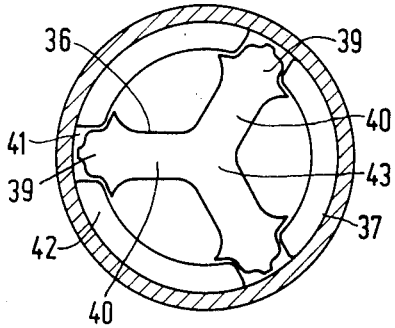
FIG. 7 is a sectional view taken on the line VII—VII in FIG. 6 but with the central bearing member omitted in the interests of clarity.

The additional resilient element 36 is constructed as a spider consisting of a body of a sheet material (see FIGS. 6 and 7) having three arms 40 which radiate from a central portion 43 and of which the free ends 39 engage in recesses 41 in the rim 42 of the member 37 so that the central portion 43 of the resilient element 36 is axially deflexible. Instead of the spider shape the body of sheet material may have other shapes provided that an adequate resilience in the necessary direction is obtained.

In the assembled condition of the dry-shaving apparatus the cutting elements 8 of the internal shaving member 6 will generally bear against the inner side 44 of the shaving portion 4 of the external shaving member 3, whilst the upper surface 33 of the central portion 24 of the coupling member 22 bears against the ball 34, which in turn bears against the central portion 43 of the additional resilient element 36. Thus, the axial force exerted by the helical spring 20 is transmitted to the external shaving member 3 both via the cutting elements 8 and via the ball 34.

The frictional forces are proportional to the above axial forces. The loss of energy as a result of friction and the consequent wear depend on the distance traversed by the frictional forces. Since the cutting elements 8 are situated at very large radius from the axis of rotation 30 compared with the ball 34, it is important in order to reduce loss of energy and wear that the part of the axial force which is transmitted to the external shaving member 3 via the cutting elements 8 is small relative to the part of the axial force which is transmitted via the ball 34.

For example, a pressure of 100 grammes may be chosen, i.e. the helical spring 20 is precompressed in such a way that the external shaving member 3, if it is not subjected to any other external forces, exerts a force of 100 grammes on the holder 2 via the flange 21. It is now possible to select a force of 20 grammes for the force acting between the cutting elements 8 and the external shaving member, so that the ball 34 should transmit a force of 80 grammes.

The force transmitted via the central bearing spacer member, i.e. via the ball 34, can be easily adjusted by means of the member 37 during manufacture of the dry-shaving apparatus. This member is moved axially inside the holder 35 until a force of, for example, 80 grammes is obtained between the additional resilient element 36, the ball 34 and the central portion 7 of the internal shaving member 6. The member 37 is then secured inside the holder, for example by means of an adhesive. Alternatively, the member 37 may be secured in the holder by means of, for example, cooperating screwthreads, so that adjustment is possible by rotating the member 37 relative to the holder 35.

From the point of view of production engineering the above construction with its additional resilient element is advantageous, because any dimensional deviations which may occur during the manufacture of the parts of the shaving unit 9 have no influence on the distribution of the axial forces, the spacer 37 being adjusted directly for the respective combination of internal and external shaving members. However, it is also conceivable that the adjustment of the force exerted by the additional resilient element is effected separately for the external shaving member 3 if the manufacturing tolerances are so small that the variations in the force ratio produced when the internal and the external shaving members are subsequently pressed against each other remain within acceptable limits.

A construction without the additional resilient element 36, i.e. a substantially rigid mounting of the central member 34 between the internal shaving member and the external shaving member in such a way that the two shaving members contact each other both at the location of the cutting elements 8 and at the location of the central bearing member 34, requires a very high manufacturing accuracy or grinding of the two shaving members to match each other, which methods are expensive and time-consuming and therefore not suitable for mass production. The force ratio thus established will not remain constant and during use of the shaving apparatus it will vary in an uncontrolled manner, depending on the wear at the ends of the cutting elements 8 and of the central bearing member 34.

Instead of the plate spring 36 it is obviously possible to use a helical spring or a spring of a different type for the additional resilient element.

Figure 8:
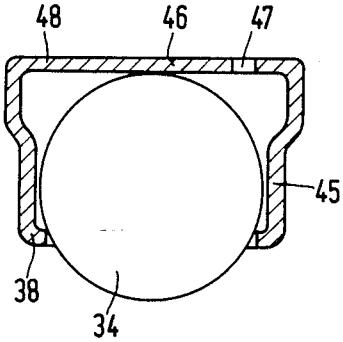
FIG. 8 is a sectional view similar to FIG. 6 of a modified version of the holder shown in FIGS. 6 and 7.
Figure 9:
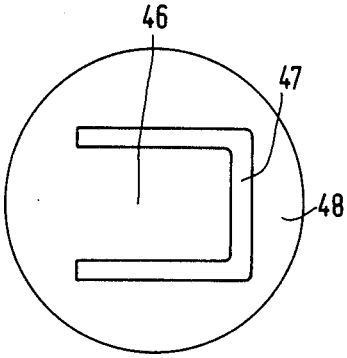
FIG. 9 is a plan view of the holder shown in FIG. 8.

In the embodiment shown in FIGS. 8 and 9 the central bearing member 34, which is again constructed as a ball, is also situated in a holder 45. The ball bears against an additional resilient element 46 which forms part of the holder 45. The additional resilient element 46 is constructed as a resilient tongue which is formed by forming a U-shaped slot 47 in the upper wall 48 of the holder 45. After adjustment of the force distribution between the parts of the internal shaving member and the external shaving member the holder may be secured to the external shaving member, for example, by spot-welding.

Alternatively, the additional resilient element may be integral with one of the shaving members. For example, it is conceivable that that part of the central body 7 of the internal shaving member 6 in the embodiment described above which comprises the spokes 26 and the central portion 27 is dimensioned in such a way that it has a resilience such that it can replace the resilient element 36. The central bearing member 34 may then be rigidly secured to the external shaving member 3 for example, by spot-welding. The coupling member 22 may then be dispersed with, so that the coupling fingers 29 of the coupling spindle 10 cooperate directly with the spokes 26.

Generally, the stiffness of the additional resilient element 36 should be as high as possible. If the internal shaving member 6 is urged away from the external shaving member by external forces such as may occur during shaving, the part of the pressure exerted by the resilient element via the cutting elements 8 will increase rapidly, which is beneficial for the shaving quality of the apparatus.

Since the energy losses are very small in the above embodiments, this yields the advantage that a smaller and lower-power drive motor may be used, so that the weight of the apparatus can be reduced, whilst in addition a greater freedom in the design of the apparatus is obtained.

For a battery-powered apparatus the reduced power requirement means an extension of the shaving time of the apparatus before the power source is exhausted.

Another advantage of the construction described in the foregoing is that the apparatus operates more quietly.

What is claimed is:

1. A dry-shaving apparatus including a shaving unit comprising an external shaving member provided with hair-entry apertures; an internal shaving member associated with and rotatable relative to the external shaving member, said internal shaving member being formed with a plurality of cutting blades for engagement with the external shaving member; a first resilient element engaging the internal shaving member and exerting pressure thereagainst; a ball bearing member centrally positioned between the external shaving member and the internal shaving member and engaging the internal shaving member; and a second resilient element associated with the external shaving member and engaging the ball bearing member.

2. A dry-shaving apparatus according to claim 1, in which the external shaving member includes a holder for the ball bearing member.

3. A dry-shaving apparatus according to claim 2, in which the second resilient element is positioned within the holder.

4. A dry-shaving apparatus according to claim 2, in which the second resilient element forms part of the holder.

5. A dry-shaving apparatus according to claim 1, in which the second resilient element is formed integrally with the external shaving member.

6. A dry-shaving apparatus according to claim 1, in which the second resilient element is formed from sheet material.

* * * * *